US010739047B2

(12) United States Patent
Su et al.

(10) Patent No.: US 10,739,047 B2
(45) Date of Patent: Aug. 11, 2020

(54) HEAT EXCHANGE DEVICE SUITABLE FOR LOW PRESSURE REFRIGERANT

(71) Applicants: Johnson Controls Technology Company, Auburn Hills, MI (US); York (Wuxi) Air Conditioning and Refrigeration Company, Ltd., Wuxi (CN); Johnson Controls Building Efficiency Technology (Wuxi) Co., Limited, Wuxi (CN)

(72) Inventors: Xiuping Su, Wuxi (CN); Li Wang, Wuxi (CN)

(73) Assignees: Johnson Controls Technology Company, Auburn Hills, MI (US); York (Wuxi) Air Conditioning and Refrigeration Company, Ltd., Wuxi (CN); Johnson Controls Building Efficiency Technology (Wuxi) Co., Limited, Wuxi (CN)

( * ) Notice: Subject to any disclaimer, the term of this patent is extended or adjusted under 35 U.S.C. 154(b) by 116 days.

(21) Appl. No.: 16/081,007

(22) PCT Filed: Feb. 28, 2017

(86) PCT No.: PCT/US2017/019965
§ 371 (c)(1),
(2) Date: Aug. 29, 2018

(87) PCT Pub. No.: WO2017/151626
PCT Pub. Date: Sep. 8, 2017

(65) Prior Publication Data

US 2019/0086128 A1 Mar. 21, 2019

(30) Foreign Application Priority Data

Feb. 29, 2016 (CN) ..... 2016 1 0112227
Feb. 29, 2016 (CN) ..... 2016 2 0153761 U

(51) Int. Cl.
*F25B 1/06* (2006.01)
*F25B 39/00* (2006.01)
(Continued)

(52) U.S. Cl.
CPC ..... *F25B 39/00* (2013.01); *F25B 1/06* (2013.01); *F28D 7/16* (2013.01); *F25B 39/028* (2013.01);
(Continued)

(58) Field of Classification Search
CPC .. C25B 11/02; C25B 1/26; C25C 1/00; C25C 1/12; C25C 7/02; C25C 7/06
See application file for complete search history.

(56) References Cited

FOREIGN PATENT DOCUMENTS

JP S61140750 A 6/1986
JP H04116205 A 4/1992
(Continued)

OTHER PUBLICATIONS

2010 Prius first with ejector-cycle air conditioning, Automotive Engineering International, SAE International, Sep. 1, 2009, pp. 31-32, vol. 117, No. 9, XP001547787, ISSN: 1543-849X, Warrendale, PA.

(Continued)

*Primary Examiner* — Filip Zec
(74) *Attorney, Agent, or Firm* — Fletcher Yoder, P.C.

(57) ABSTRACT

Embodiments of the present disclosure are directed to a heat exchange device that includes a condenser configured to receive a refrigerant, an evaporator having an evaporation tube bundle, a throttling device configured to receive a first portion of the refrigerant from the condenser and to expand the first portion of the refrigerant before directing the first portion to the evaporator, and an ejector having a high pressure conduit, a low pressure conduit, and an outlet conduit, the ejector is configured to receive the first portion
(Continued)

from the throttling device or a second portion of the refrigerant from the condenser via the high pressure conduit, receive a third portion of the refrigerant from the evaporator via the low pressure conduit, mix the first portion or the second portion with the third portion to form a mixed refrigerant, and direct the mixed refrigerant to the evaporator via the outlet conduit.

20 Claims, 3 Drawing Sheets

(51) Int. Cl.

| | |
|---|---|
| ***F28D 7/16*** | (2006.01) |
| *F28D 21/00* | (2006.01) |
| *F25B 39/02* | (2006.01) |

(52) U.S. Cl.
CPC . *F25B 2339/0242* (2013.01); *F25B 2339/047* (2013.01); *F25B 2341/0011* (2013.01); *F25B 2341/0012* (2013.01); *F28D 2021/0064* (2013.01)

(56) References Cited

FOREIGN PATENT DOCUMENTS

| | | | |
|---|---|---|---|
| JP | H08145502 | A | 6/1996 |
| JP | 2008051395 | A | 3/2008 |
| JP | 2009138952 | A | 6/2009 |
| JP | 2015515601 | A | 5/2015 |

OTHER PUBLICATIONS

International Search Report and Written Opinion for PCT Application No. PCT/US17/19965 dated Aug. 1, 2017, 21 pgs.
Japanese Office Action for JP Application No. 2018-546425 dated Sep. 10, 2019, 6 pgs.
Korean Office Action for KR Application No. 10-2018-7027873 dated Oct. 16, 2019, 7 pgs.

HEAT EXCHANGE DEVICE SUITABLE FOR LOW PRESSURE REFRIGERANT

CROSS-REFERENCE TO RELATED APPLICATIONS

This application is a National Stage of PCT Application No. PCT/US17/19965, entitled "HEAT EXCHANGE DEVICE SUITABLE FOR LOW PRESSURE REFRIGERANT," filed on Feb. 28, 2017, which is herein incorporated by reference in its entirety, and which claims priority to Chinese Patent Application No. 201610112227.4, entitled "HEAT EXCHANGE DEVICE SUITABLE FOR LOW-PRESSURE REFRIGERANT," filed on Feb. 29, 2016, and Chinese Patent Application No. 201620153761.5, entitled "HEAT EXCHANGE DEVICE SUITABLE FOR LOW-PRESSURE REFRIGERANT," filed on Feb. 29, 2016, which are herein incorporated by reference in their entireties.

BACKGROUND

The present disclosure relates to heating, ventilating, air conditioning, and refrigeration (HVAC&R) systems, and specifically, to a heat exchange device suitable for a low pressure refrigerant.

Falling-film evaporators have been applied to HVAC&R systems to enhance heat transfer efficiency and reduce refrigerant charge. Unfortunately, typical falling-film evaporators may include a refrigerant dispenser that causes refrigerant to incur a relatively high pressure differential due to typical falling-film evaporators used in systems that utilize relatively high pressure refrigerants. Therefore, a heat exchange device which is suitable for a low pressure refrigerant environment is desired.

SUMMARY

Embodiments of the present disclosure relate to provide a heat exchange device suitable for a low pressure refrigerant that increases distribution of refrigerant in the heat exchange device.

In some embodiments, a heat exchange device suitable for a low pressure refrigerant includes a condenser configured to receive a refrigerant, an evaporator having an evaporation tube bundle configured to place the refrigerant in a heat exchange relationship with a fluid flowing through the evaporation tube bundle, a throttling device disposed between the evaporator and the condenser, where the throttling device is configured to receive a first portion of the refrigerant from the condenser, and the throttling device is configured to expand the at least first portion of the refrigerant before directing the first portion of the refrigerant to the evaporator, and an ejector disposed between the evaporator and the condenser, where the ejector includes a high pressure conduit, a low pressure conduit, and an outlet conduit, the ejector is configured to receive the first portion from the throttling device or a second portion of the refrigerant from the condenser via the high pressure conduit, the ejector is configured to receive a third portion of the refrigerant from the evaporator via the low pressure conduit, and the ejector is configured to mix the first portion or the second portion of the refrigerant with the third portion of the refrigerant to form a mixed refrigerant and direct the mixed refrigerant to the evaporator via the outlet conduit.

In some embodiments, a refrigerant dispenser, a falling-film tube bundle, and a gas-liquid separation chamber are disposed in the evaporator, and the evaporation tube bundle is a falling-film tube bundle.

In some embodiments, the high pressure conduit of the ejector is in fluid communication with a refrigerant outlet of the condenser, the low pressure conduit of the ejector is in fluid communication with a bottom portion of the evaporator, the outlet conduit of the ejector is in fluid communication with a refrigerant inlet of the evaporator, and the throttling device is disposed between the refrigerant outlet of the condenser and the refrigerant inlet of the evaporator.

In some embodiments, a refrigerant outlet of the condenser is in fluid communication with a refrigerant inlet of the evaporator, a first flow path tube bundle and a second flow path tube bundle are disposed in the evaporator, the throttling device is disposed between the refrigerant outlet of the condenser and the high pressure conduit of the ejector, the low pressure conduit of the ejector is in fluid communication with a bottom portion of the second flow path tube bundle of the evaporator, and the outlet conduit of the ejector is in fluid communication with a bottom portion of the first flow path tube bundle of the evaporator.

In some embodiments, a partition plate may be disposed between the first flow path tube bundle and the second flow path tube bundle.

In some embodiments, the condenser includes a refrigerant inlet, a refrigerant outlet, a condenser tube bundle, an impingement plate, and a subcooler.

In some embodiments, the present disclosure relates a method of using a heat exchange device that includes receiving a refrigerant in a condenser via a refrigerant inlet of the condenser, directing a first portion of the refrigerant from a refrigerant outlet of the condenser to a throttling device disposed between the condenser and an evaporator, directing the first portion from the throttling device or a second portion of the refrigerant from the refrigerant outlet of the condenser to an ejector disposed between the condenser and the evaporator, drawing a third portion of the refrigerant from the evaporator to the ejector via a high pressure jet effect caused by the first portion or the second portion of the refrigerant in the ejector, combining the first portion or the second portion of the refrigerant with the third portion of the refrigerant in the ejector to form a mixed refrigerant, and directing the mixed refrigerant to the evaporator.

The heat exchange device suitable for a low pressure refrigerant provided by the present disclosure may include a simple structure, increase heat transfer efficiency, and/or reduce refrigerant charge.

DRAWINGS

DETAILED DESCRIPTION

Figure 1:
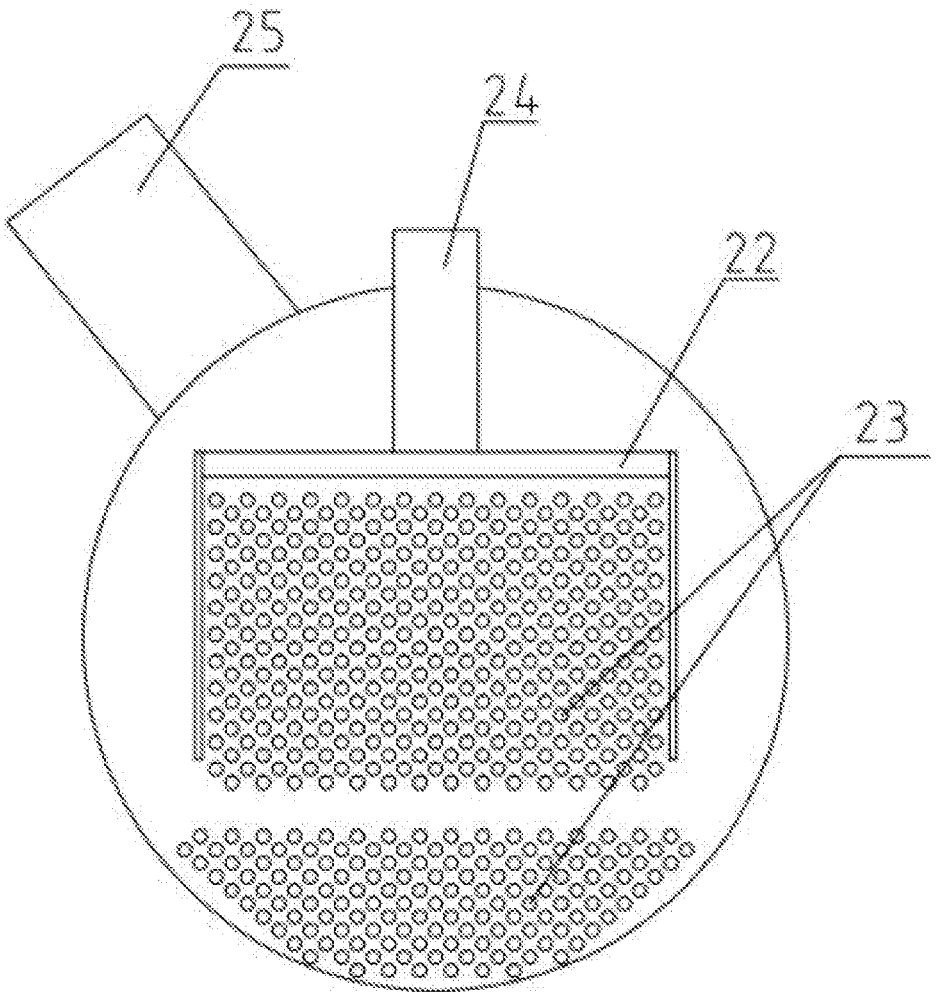
FIG. 1 PRIOR ART
FIG. 1 is a schematic illustration of a conventional falling-film evaporator.

A typical falling-film evaporator configured to utilize a relatively high pressure refrigerant (e.g., R134a) may generally include a structure as shown in FIG. 1. For example, as shown in the illustrated embodiment of FIG. 1, the falling-film evaporator may include an evaporator outlet 25, a liquid inlet 24, a refrigerant dispenser 22, and/or evaporation tube bundles 23. In some embodiments, a gas-liquid refrigerant (e.g., two-phase refrigerant) may pass through the liquid inlet 24 and enter the evaporator after passing through the refrigerant dispenser 22. Once the refrigerant enters the evaporator, refrigerant droplets (e.g., liquid refrigerant) may fall onto the evaporation tube bundles 23, such that the refrigerant droplets absorb heat from fluid in the evaporation tube bundles 23 and evaporate into refrigerant vapor. The generated refrigerant vapor is then discharged via the evaporator outlet 25, where it may enter a compressor.

The refrigerant dispenser 22 may enhance uniform distribution of the refrigerant onto the evaporation tube bundles 23. However, typical falling-film evaporators may be configured to utilize a relatively high pressure refrigerant (e.g., R134a). Therefore, the refrigerant dispenser 22 may include a pressure difference that accommodates the high pressure refrigerant to ultimately direct the refrigerant over the evaporation tube bundles 23. For example, in some cases, the pressure difference across the refrigerant dispenser may be up to 150 kilopascals (kPa) or up to 300 kPa.

In accordance with embodiments of the present disclosure, the refrigeration system may include a low pressure refrigerant, such as R12336zd(E). Low pressure refrigerants are becoming more desirable because they are generally more environmentally friendly and efficient than high pressure refrigerants. Table 1 shows a comparison between respective evaporation pressures and condensation pressures of R1233zd(E) and R134a under typical refrigeration working conditions (with an evaporation temperature of 5° C. and a condensation temperature of 36.7° C.). As shown, a difference between the evaporation pressure (Pevap, kPA) and the condensation pressure (Pcond, kPa) of R1233zd(E) is 23.1% of the pressure difference of R134a. Accordingly, the refrigerant dispenser 22 may be configured to accommodate the large pressure difference of relatively high pressure refrigerants to distribute the high pressure refrigerants over the evaporation tube bundles 23. However, such a pressure difference may be too high for low pressure refrigerants, such that the refrigerant dispenser 22 may not sufficiently distribute low pressure refrigerant over the evaporation tube bundles 23 (e.g., the low pressure refrigerant may simply fall through the refrigerant dispenser 22 without dispersing towards ends of the refrigerant dispenser 22).

TABLE 1

Typical refrigeration operating conditions

| | R1233zd(E) | R134a | R1233zd(E) vs R134a |
|---|---|---|---|
| Tevap | 5 | 5 | |
| Tcond | 36.7 | 36.7 | |
| Pevap, kPa | 59.44 | 349.66 | 17.0% |
| Pcond, kPa | 193.65 | 929.57 | 20.8% |
| Compression Ratio | 3.26 | 2.66 | 122.6% |
| Pressure Difference, kPa | 134.21 | 579.91 | 23.1% |

Embodiments of the present disclosure relate to a heat exchange device that includes a throttling device. Two ends of the throttling device may be respectively connected to an outlet of a condenser and an inlet of an evaporator. During operation, an ejector may receive liquid refrigerant from a bottom of the evaporator by utilizing a high pressure jet effect caused by liquid in a high pressure conduit of the ejector. In some embodiments, the liquid refrigerant from the ejector may combine with refrigerant exiting the throttling device and enter the inlet of the evaporator where it may be directed to a refrigerant dispenser of the evaporator.

Embodiment 1

Figure 2:
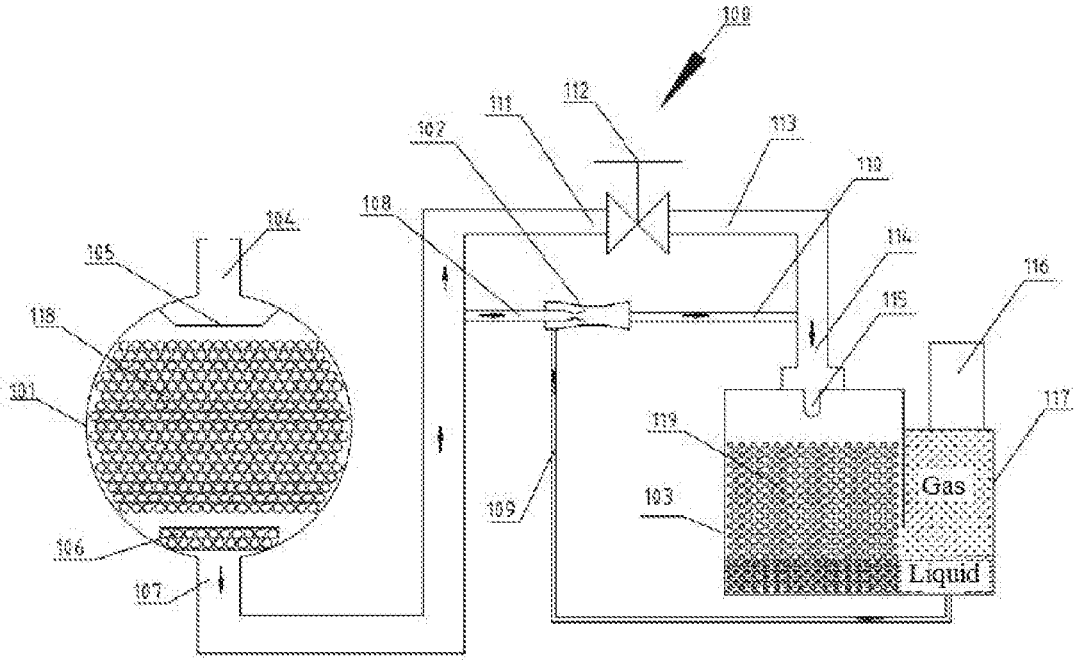
FIG. 2 is a schematic of an embodiment of a heat exchange device suitable for use with a low-pressure refrigerant, in accordance with an embodiment of the present disclosure.

For example, FIG. 2 is a schematic of an embodiment of a heat exchange device suitable for a low pressure refrigerant. As shown in the illustrated embodiment of FIG. 2, the heat exchange device may include a condenser 101, a throttling device 112, and an evaporator 103. An evaporation tube bundle 119 (e.g., falling-film tube bundle) is disposed in the evaporator 103 to place refrigerant in the evaporator 103 in a heat exchange relationship with fluid flowing through the evaporation tube bundle 119. In addition to the throttling device 112, an ejector 102 may also be positioned between the condenser 101 and the evaporator 103. In some embodiments, the ejector 102 has a high pressure conduit 108, a low pressure conduit 109, and an outlet conduit 110. As such, the ejector 102 may direct a refrigerant liquid in the evaporator 103 back into the evaporator 103 for redistribution over the evaporation tube bundle 119. The condenser 101 may include a refrigerant inlet 104 and a refrigerant outlet 107. Additionally, a condenser tube bundle 118, an impingement plate 105, and a subcooler 106 may be disposed within the condenser 101. Similarly, the evaporator 103 may include a refrigerant inlet 114, a refrigerant dispenser 115 disposed within the evaporator 103 at an upper portion of the evaporator 103, and the evaporation tube bundle 119 (e.g., a falling-film tube bundle) disposed in the evaporator 103 below the refrigerant dispenser 115. The evaporator 103 is further provided with a gas-liquid separation chamber 117 and a refrigerant outlet 116.

As shown in the illustrated embodiment of FIG. 2, the ejector 102 and the throttling device 112 are arranged in parallel with respect to a flow of the refrigerant from the condenser 101 to the evaporator 103. The outlet conduit 110 of the ejector 102 and an outlet conduit 113 of the throttling device 112 are in communication with the refrigerant inlet 114 of the evaporator 103. Additionally, the high pressure conduit 108 of the ejector 102 and an inlet conduit 111 of the throttling device 112 are in communication with the refrigerant outlet 107 of the condenser 101 (e.g., the refrigerant outlet 107 is at a bottom portion of the condenser 101). Further still, the low pressure conduit 109 of the ejector 102 is in fluid communication with a bottom portion of the evaporator 103.

During operation, the refrigerant may enter the condenser 101 via the refrigerant inlet 104 of the condenser 101. The refrigerant may then be directed onto the impingement plate 105, which may distribute the refrigerant over the condenser tube bundle 118 to place the refrigerant in a heat exchange relationship with a fluid flowing through the condenser tube bundle 118 (e.g., the fluid flowing through the condenser tube bundle 118 may absorb thermal energy from the refrigerant to cool the refrigerant). After passing over the condenser tube bundle 118, the refrigerant may flow over the subcooler 106, which may further cool the refrigerant via a fluid flowing through tubes of the subcooler 106 (e.g., the fluid flowing through the subcooler 106 may absorb thermal energy from the refrigerant to further cool the refrigerant).

The refrigerant may then flow out of the condenser 101 via the refrigerant outlet 107 of the condenser 101.

A first portion of the refrigerant from the refrigerant outlet 107 of the condenser 101 may be directed into the throttling device 112 via the inlet conduit 111 of the throttling device 112. A second portion of the refrigerant may be directed into the ejector 102 via the high pressure conduit 108 of the ejector 102. Additionally, a high pressure jet effect caused by the second portion of the refrigerant in the high pressure conduit 108 of the ejector 102 may direct liquid refrigerant at a bottom portion of the evaporator 103 into the ejector 102 via the low pressure conduit 109 of the ejector 102. The refrigerant that enters the ejector 102 via the high pressure conduit 108 and the refrigerant that enters the ejector 102 via the low pressure conduit 109 mix to form a medium pressure two-phase refrigerant (e.g., a mixed refrigerant). The medium pressure two-phase refrigerant may flow through the outlet conduit 110 toward the inlet 114 of the evaporator 103. Accordingly, the medium pressure two-phase refrigerant may mix with the refrigerant exiting the throttling device 112 via the outlet conduit 113 to form a mixture. After being directed into the evaporator 103 via the refrigerant inlet 114, the mixture may be distributed (e.g., dripped) over the evaporation tube bundle 119 via the dispenser 115. The mixture passing over the evaporation tube bundle 119 (e.g., falling-film tube bundle) may enter the gas-liquid separation chamber 117 where refrigerant liquid and refrigerant vapor may be separated from one another. The refrigerant vapor may be returned to a compressor (not shown in the figure) via the refrigerant outlet 116 and the refrigerant liquid may be directed to the low pressure conduit 109 of the ejector 102.

As discussed above, the high pressure jet effect caused by the refrigerant liquid in the high pressure conduit 108 of the ejector 102 draws the refrigerant liquid at the bottom portion of the evaporator 103 into the low pressure conduit 109 of the ejector 102. A medium pressure two-phase refrigerant is formed by mixing the high pressure refrigerant in the high pressure conduit 108 and the low pressure refrigerant in the low pressure conduit 109. The medium pressure two-phase refrigerant is then mixed with the refrigerant that passes through the throttling device 112 and enters the refrigerant dispenser 115 in the evaporator 103 for distribution. Because of the ejector 102, an increased pressure difference occurs between refrigerant upstream of the refrigerant dispenser 115 and refrigerant downstream of the refrigerant dispenser 115. For example, the increased pressure difference that results from inclusion of the ejector 102 may be greater than that of a conventional falling-film evaporator (see, e.g., FIG. 1), which may improve a uniformity of refrigerant distribution in the evaporator 103.

Embodiment 2

Figure 3:
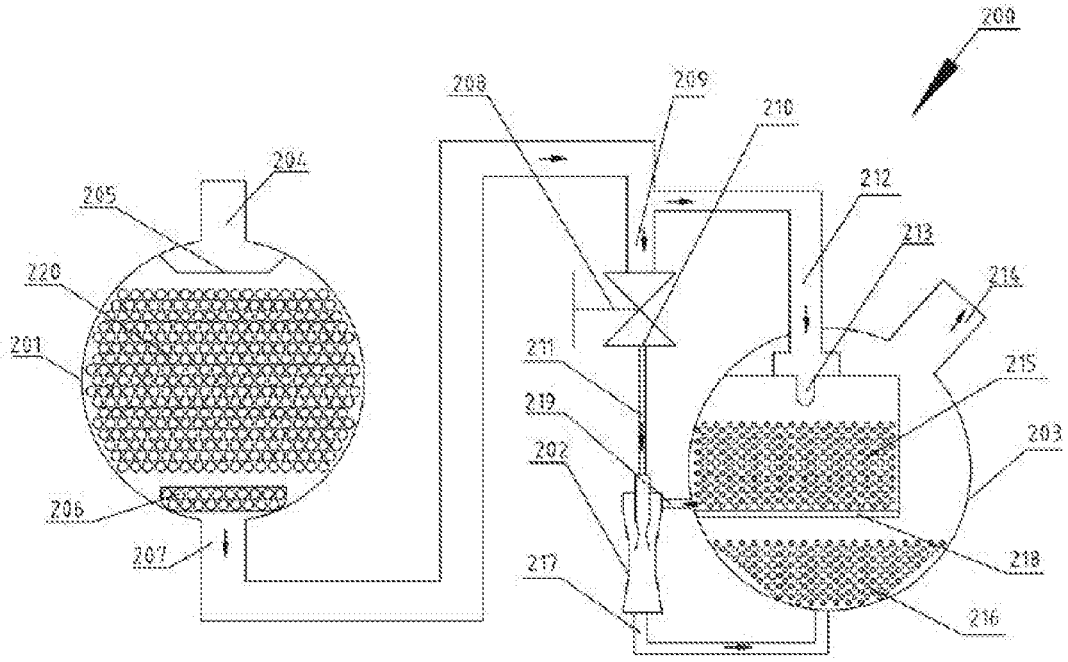
FIG. 3 is schematic of an embodiment of a heat exchange device suitable for use with a low-pressure refrigerant, in accordance with an embodiment of the present disclosure.

FIG. 3 is a schematic of another embodiment of a heat exchange device suitable for a low pressure refrigerant. As shown in the illustrated embodiment of FIG. 3, the heat exchange device may include a condenser 201, a throttling device 208, and an evaporator 203. Additionally, an ejector 202 is positioned between the condenser 201 and the evaporator 203. The evaporator 203 may include a refrigerant inlet 212 and a refrigerant outlet 214. The evaporator 203 may also include an evaporation tube bundle, which may include a first flow path tube bundle 216 and a second flow path tube bundle 215. In some embodiments, the first flow path tube bundle 216 is a flooded tube bundle, and the second flow path tube bundle 215 is a falling-film tube bundle. However, in other embodiments, the first flow path tube bundle 216 and the second flow path tube bundle 215 may be other suitable types of tube bundles. Further, a refrigerant dispenser 213 may be positioned above the second flow path tube bundle 215 and a partition plate 218 may be mounted between the first flow path tube bundle 216 and the second flow path tube bundle 215. In some embodiments, the first flow path tube bundle 216 may include an inlet at a bottom portion of the first flow path tube bundle 216, and the second flow path tube bundle 215 may include an outlet at a bottom portion of the second flow path tube bundle 215.

As shown in the illustrated embodiment of FIG. 3, the ejector 202 has a high pressure conduit 211, a low pressure conduit 219, and an outlet conduit 217. Additionally, the throttling device 208 may include an inlet conduit 209 and an outlet conduit 211. The condenser 201 includes a refrigerant inlet 204, a refrigerant outlet 207, a condenser tube bundle 220, an impingement plate 205, and/or a subcooler 206 disposed within the condenser 201. As shown in the illustrated embodiment of FIG. 3, the high pressure conduit 211 of the ejector 202 is arranged in series with the throttling device 208, and is positioned downstream of the throttling device 208 with respect to a flow of the refrigerant from the condenser 201 to the evaporator 203. For example, the high pressure conduit 211 may be in fluid communication with the outlet 210 of the throttling device 208. Additionally, the low pressure conduit 219 of the ejector 202 may be in fluid communication with the outlet of the second flow path tube bundle 215 (e.g., the outlet positioned at the bottom portion of the second flow path tube bundle 215) of the evaporator 203. The outlet conduit 217 of the ejector 202 may be in fluid communication with the inlet of the first flow path tube bundle 216 (e.g., the inlet positioned at the bottom portion of the first flow path tube bundle 216) of the evaporator 203. The refrigerant outlet 207 of the condenser 201 is thus divided into two paths, where a first path is in fluid communication with the refrigerant inlet 212 of the evaporator 203 and the second path is in fluid communication with the inlet conduit 209 of the throttling device 208.

Figure 4:
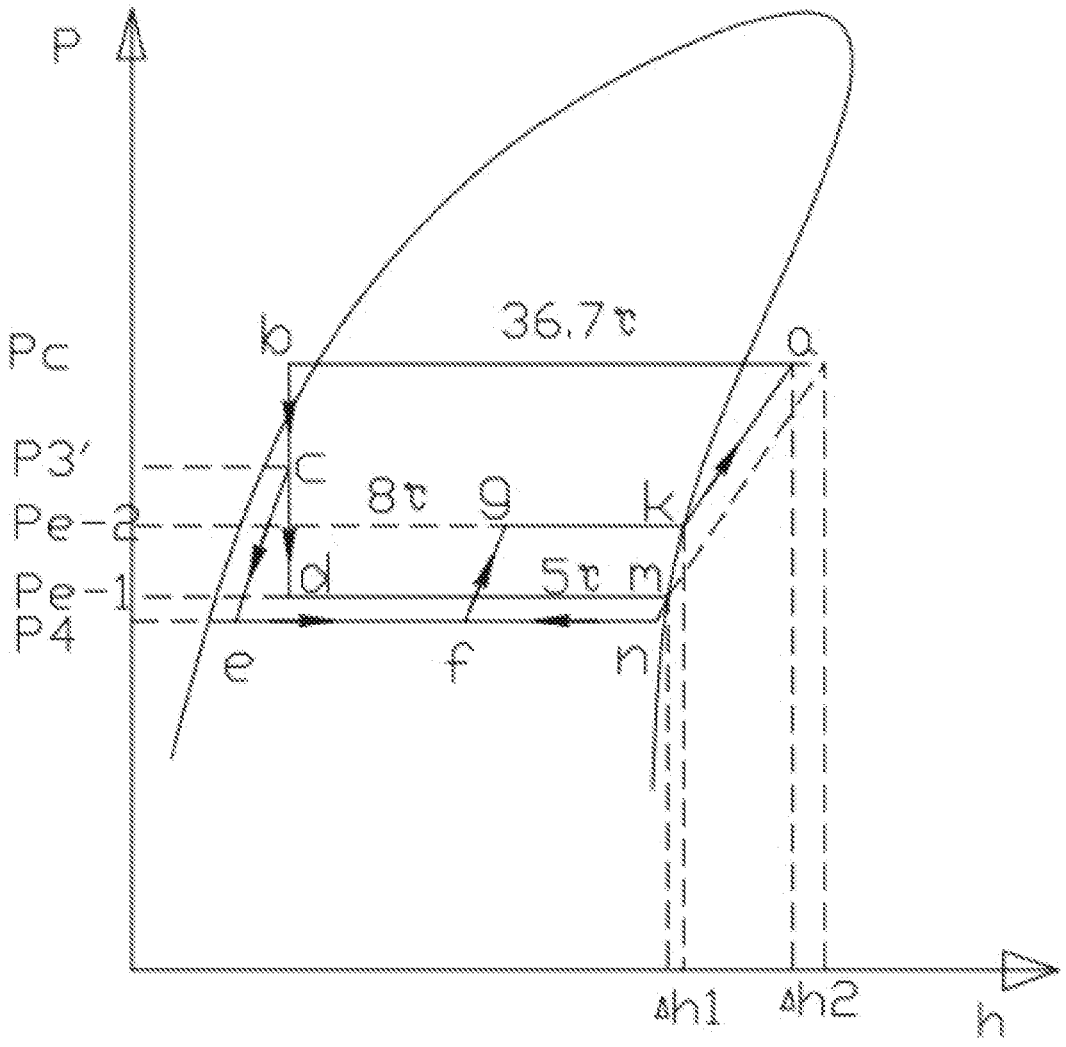
FIG. 4 is a chart of a pressure-enthalpy diagram for a system that may utilize the heat exchange devices of FIGS. 2 and 3, in accordance with an embodiment of the present disclosure.

As shown in the illustrated embodiments of FIGS. 3 and 4, refrigerant enters the condenser 201 via the refrigerant inlet 204 of the condenser 201. The refrigerant is distributed over the condenser tube bundle 220 by the impingement plate 205 to place the refrigerant in a heat exchange relationship with fluid flowing through the condenser tube bundle 220 (e.g., the fluid flowing through the condenser tube bundle 220 may absorb thermal energy from the refrigerant to cool the refrigerant). The refrigerant may then flow toward the subcooler 206, where the refrigerant may be further cooled by being placed in a heat exchange relationship with fluid flowing through tubes of the subcooler 206 (e.g., the fluid flowing through the subcooler 206 absorbs thermal energy from the refrigerant). The refrigerant may then flow out of the condenser 201 via the refrigerant outlet 207 of the condenser 201.

As discussed above, the refrigerant outlet 207 may eventually split the refrigerant exiting the condenser 201 (e.g., high-temperature, high-pressure refrigerant liquid) into two paths. For example, a first portion of the refrigerant from the refrigerant outlet 207 may be directed into the evaporator 203 via the refrigerant inlet 212 of the evaporator 203. Additionally, a second portion of the refrigerant from the refrigerant outlet 207 may be directed into the throttling device 208 via the inlet conduit 209 of the throttling device 208. The first portion of the refrigerant that is directed into the evaporator 203 via the refrigerant inlet 212 may be throttled (e.g., expanded) by the dispenser 213. For example, a pressure of the first portion of the refrigerant may be reduced from Pc to Pe-1 (see, e.g., FIG. 4). Additionally, a temperature of the first portion of the refrigerant may also be reduced (e.g., FIG. 4 shows that the temperature of the refrigerant is approximately 5° C.). The first portion of the refrigerant may then be directed over the second flow path tube bundle 215 of the evaporator 203 to place the first portion of the refrigerant in a heat exchange relationship with a fluid flowing through the second flow path tube bundle 215 (e.g., the first portion of the refrigerant may absorb thermal energy from the fluid flowing through the second flow path tube bundle 215).

Additionally, the second portion of the refrigerant that enters the throttling device 208 may be throttled (e.g., expanded) by the throttling device 208. For example, a pressure of the second portion of the refrigerant may be reduced from Pc to P3' (see, e.g., FIG. 4), and the second portion of the refrigerant may become a medium pressure refrigerant before being directed into the high pressure conduit 211 of the ejector 202. A high pressure jet effect caused by the second portion of the refrigerant in the high pressure conduit 211 of the ejector 202 may draw refrigerant liquid (e.g., the first portion of the refrigerant) collected at a bottom portion of the second flow path tube bundle 215 of the evaporator 203 into the low pressure conduit 219 of the ejector 202. Accordingly, an amount of the first portion of the refrigerant and the second portion of the refrigerant may mix in the ejector 202. In some embodiments, a pressure of the first portion of the refrigerant a may increase from Pe-1 to Pe-2 (see, e.g., FIG. 4). Additionally, a temperature of the mixture of the first portion of the refrigerant and the second portion of the refrigerant may increase (e.g., FIG. 4 shows that the temperature of the refrigerant rises to approximately 8° C.). The mixture of the first portion of the refrigerant and the second portion of the refrigerant may then be directed into the first flow path tube bundle 216 of the evaporator 203 via the outlet conduit 217 of the ejector 202 to place the mixture of the first portion of the refrigerant and the second portion of the refrigerant in a heat exchange relationship with a fluid flowing through the first flow path tube bundle 216 (e.g., the mixture of the first portion of the refrigerant and the second portion of the refrigerant may absorb thermal energy from the fluid flowing through the first flow path tube bundle 216). In some embodiments, the mixture of the first portion of the refrigerant and the second portion of the refrigerant may evaporate (e.g., form a refrigerant vapor), such that refrigerant vapor may be returned to a compressor (not shown) via the refrigerant outlet 214.

FIG. 4 is a pressure-enthalpy diagram of a refrigeration cycle that may include one or more of the embodiments of the heat exchange device of the present disclosure. As shown in the illustrated embodiment of FIG. 4, Point "a" represents a pressure and an enthalpy value corresponding to refrigerant within the refrigerant inlet 204 of the condenser 201. Point "b" represents a pressure and an enthalpy value corresponding to refrigerant within the refrigerant outlet 207 of the condenser 201. Point "c" represents a pressure and an enthalpy value corresponding to refrigerant within the high pressure conduit 211 of the ejector 202. Point "d" represents a pressure and an enthalpy value of the refrigerant after throttling (e.g., expanding) the refrigerant through the dispenser 213 in the evaporator 203. Points "e," "f," and "n" represent pressure and enthalpy values of the refrigerant within the ejector. Point "g" represents a pressure and an enthalpy value corresponding to refrigerant within the outlet conduit 217 of the ejector 202. Point "m" represents a pressure and an enthalpy value corresponding to refrigerant within the low pressure conduit of the ejector 202. Finally, Point "k" represents a pressure and an enthalpy value corresponding to refrigerant within the refrigerant outlet 214 of the evaporator 203.

When compared with the embodiment of FIG. 2, the illustrated embodiment of FIG. 3 may further increase a pressure difference of the refrigerant upstream of the dispenser 213 and the refrigerant downstream of the dispenser 213 (e.g., the pressure difference may be substantially equal to a pressure difference of the refrigerant in the condenser and the refrigerant in the evaporator), thereby improving uniformity of distribution of the refrigerant over at least the second flow path tube bundle 215. Further, the illustrated embodiment of FIG. 3 may enable the evaporator 203 to discharge the refrigerant with an increased pressure, thereby improving an efficiency of the overall system. For example, as shown in FIG. 4, the pressure of the discharged refrigerant from the evaporator 203 is Pe-2, whereas a pressure of the discharged refrigerant from the evaporator 103 and/or a typical evaporator is Pe-1. Thus, utilizing the embodiment of FIG. 3 may achieve a power consumption savings represented by $\Delta h1+\Delta h2$.

While only certain features and embodiments have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described (i.e., those unrelated to the presently contemplated best mode of carrying out the embodiments of the present disclosure, or those unrelated to enabling the claimed disclosure). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heat exchange device suitable for a low pressure refrigerant, comprising:

a condenser configured to receive a refrigerant;

an evaporator comprising an evaporation tube bundle configured to place the refrigerant in a heat exchange relationship with a fluid flowing through the evaporation tube bundle;

a throttling device disposed between the evaporator and the condenser, wherein the throttling device is configured to receive a first portion of the refrigerant from the condenser, and wherein the throttling device is configured to expand the first portion of the refrigerant before directing the first portion of the refrigerant toward the evaporator; and an ejector disposed between the evaporator and the condenser, wherein the ejector comprises a high pressure conduit, a low pressure conduit, and an outlet conduit, wherein either:

the ejector is configured to receive the first portion of the refrigerant from the throttling device via the high pressure conduit, the ejector is configured to receive a third portion of the refrigerant from the evaporator via the low pressure conduit, and the ejector is configured to mix the first portion of the refrigerant with the third portion of the refrigerant to form a first mixed refrigerant and direct the first mixed refrigerant to the evaporator via the outlet conduit of the ejector, wherein the evaporator is configured to receive the first mixed refrigerant from the ejector via the outlet conduit of the ejector and a second portion of refrigerant from the condenser via a refrigerant inlet of the evaporator, the refrigerant inlet of the evaporator being in fluid communication with a refrigerant outlet of the condenser; or the ejector is configured to receive the second portion of the refrigerant from the condenser via the high pressure conduit, the ejector is configured to receive the third portion of the refrigerant from the evaporator via the low pressure conduit, and the ejector is configured to mix the second portion of the refrigerant with the third portion of the refrigerant to form a second mixed refrigerant and direct the second mixed refrigerant toward the evaporator via the outlet conduit of the ejector, and wherein the evaporator is configured to receive a mixture of the second mixed refrigerant from the ejector and the first portion of the refrigerant from the throttling device.

2. The heat exchange device of claim 1, wherein a refrigerant dispenser and a gas-liquid separation chamber are disposed in the evaporator to increase a distribution of the refrigerant over the evaporation tube bundle.

3. The heat exchange device of claim 1, wherein the evaporation tube bundle comprises a falling-film tube bundle.

4. The heat exchange device of claim 1, wherein the throttling device and the ejector are arranged in a parallel arrangement with respect to a flow of the refrigerant from the condenser to the evaporator.

5. The heat exchange device of claim 4, wherein the high pressure conduit of the ejector is in fluid communication with refrigerant outlet of the condenser, the low pressure conduit of the ejector is in fluid communication with a bottom portion of the evaporator, the outlet conduit of the ejector is in fluid communication with the refrigerant inlet of the evaporator, and the throttling device is disposed between the refrigerant outlet of the condenser and the refrigerant inlet of the evaporator.

6. The heat exchanger device of claim 1, wherein the throttling device and the ejector are arranged in a series arrangement with respect to a flow of the refrigerant from the condenser to the evaporator.

7. The heat exchange device of claim 6, wherein the refrigerant outlet of the condenser is in fluid communication with the refrigerant inlet of the evaporator, a first flow path tube bundle and a second flow path tube bundle are disposed in the evaporator, the throttling device is disposed between the refrigerant outlet of the condenser and the high pressure conduit of the ejector, the low pressure conduit of the ejector is in fluid communication with a bottom portion of the second flow path tube bundle of the evaporator, and the outlet conduit of the ejector is in fluid communication with a bottom portion of the first flow path tube bundle of the evaporator.

8. The heat exchange device of claim 7, wherein a partition plate is disposed between the first flow path tube bundle and the second flow path tube bundle.

9. The heat exchange device of claim 1, wherein the condenser comprises a refrigerant inlet, a condenser tube bundle, an impingement plate, and a subcooler.

10. A method of using a heat exchange device, comprising:

receiving a refrigerant in a condenser via a refrigerant inlet of the condenser;

directing a first portion of the refrigerant from a refrigerant outlet of the condenser to a throttling device disposed between the condenser and an evaporator;

directing the first portion from the throttling device or a second portion of the refrigerant from the refrigerant outlet of the condenser to an ejector disposed between the condenser and the evaporator;

drawing a third portion of the refrigerant from the evaporator to the ejector via a high pressure jet effect caused by the first portion or the second portion of the refrigerant in the ejector; and either:

combining the first portion of the refrigerant with the third portion of the refrigerant in the ejector to form a first mixed refrigerant, and directing the first mixed refrigerant to the evaporator, wherein the evaporator is configured to receive the first mixed refrigerant from the ejector and the second portion of the refrigerant from the refrigerant outlet of the condenser; or combining the second portion of the refrigerant with the third portion of the refrigerant in the ejector to form a second mixed refrigerant, and directing the second mixed refrigerant toward the evaporator, wherein the evaporator is configured to receive a mixture of the second mixed refrigerant and the first portion of the refrigerant.

11. The method of claim 10, wherein receiving the refrigerant in the condenser via the refrigerant inlet of the condenser comprises passing the refrigerant through an impingement plate disposed in the condenser and passing the refrigerant over a condenser tube bundle disposed in the condenser to form a liquid refrigerant.

12. The method of claim 10, wherein directing the first portion from the throttling device or the second portion of the refrigerant from the refrigerant outlet of the condenser to the ejector comprises directing the first portion from the throttling device or the second portion of the refrigerant into a high pressure conduit of the ejector.

13. The method of claim 10, wherein drawing the third portion of the refrigerant from the evaporator to the ejector via the high pressure jet effect caused by the first portion or the second portion of the refrigerant in the ejector comprises drawing the third portion of the refrigerant into a low pressure conduit of the ejector.

14. The method of claim 10, wherein combining the first portion from the throttling device or the second portion of the refrigerant with the third portion of the refrigerant in the ejector to form the first mixed refrigerant or the second mixed refrigerant, respectively, comprises forming a medium-pressure two-phase refrigerant.

15. The method of claim 10, comprising evaporating at least a portion of the first mixed refrigerant or the second mixed refrigerant into a refrigerant vapor in the evaporator and directing the refrigerant vapor to a compressor via an evaporator outlet.

16. A heat exchange device, comprising:

a condenser configured to receive a refrigerant;

an evaporator comprising an evaporation tube bundle configured to be place the refrigerant in a heat exchange relationship with a fluid flowing through the evaporation tube bundle, wherein the evaporator comprises a refrigerant inlet configured to receive a quantity of the refrigerant directly from a refrigerant outlet of the condenser;

a throttling device disposed between the evaporator and the condenser, wherein the throttling device is configured to receive a first portion of the refrigerant from the condenser, and wherein the throttling device is configured to expand the at least first portion of the refrigerant before directing the first portion of the refrigerant to the evaporator; and an ejector disposed between the evaporator and the condenser, wherein the ejector comprises a high pressure conduit, a low pressure conduit, and an outlet conduit, the ejector is configured to receive the first portion of the refrigerant from the throttling device via the high pressure conduit, the ejector is configured to receive a second portion of the refrigerant from the evaporator via the low pressure conduit, and the ejector is configured to mix the first portion of the refrigerant and the second portion of the refrigerant to form a mixed refrigerant and direct the mixed refrigerant to the evaporator via an outlet conduit.

17. The heat exchange device of claim 16, wherein the evaporation tube bundle comprises a first flow path tube bundle and a second flow path tube bundle, and wherein the second flow path tube bundle is disposed between the first flow path tube bundle and a dispenser of the evaporator.

18. The heat exchange device of claim 17, wherein the ejector is configured to receive the second portion of the refrigerant from the second flow path tube bundle and wherein the outlet conduit of the ejector is configured to direct the mixed refrigerant to the first flow path tube bundle.

19. The heat exchange device of claim 18, wherein the evaporator comprises a partition plate configured to separate the first flow path tube bundle and the second flow path tube bundle from one another.

20. The heat exchange device of claim 16, wherein the condenser comprises a refrigerant inlet and a refrigerant outlet, a condenser tube bundle, an impingement plate, and a subcooler.

* * * * *